US009546541B2

(12) United States Patent
Wang et al.

(10) Patent No.: US 9,546,541 B2
(45) Date of Patent: Jan. 17, 2017

(54) GAS LIFT VALVES

(71) Applicant: Schlumberger Technology Corporation, Sugar Land, TX (US)

(72) Inventors: Chao Wang, Missouri City, TX (US); Weng Keong Tiong, Singapore (SG); Yushan Li, Singapore (SG); Ganesh Balasubramanian, Singapore (SG)

(73) Assignee: Schlumberger Technology Corporation, Sugar Land, TX (US)

( * ) Notice: Subject to any disclaimer, the term of this patent is extended or adjusted under 35 U.S.C. 154(b) by 544 days.

(21) Appl. No.: 14/017,712

(22) Filed: Sep. 4, 2013

(65) Prior Publication Data

US 2014/0069659 A1 Mar. 13, 2014

Related U.S. Application Data

(60) Provisional application No. 61/698,589, filed on Sep. 8, 2012, provisional application No. 61/698,622, filed on Sep. 8, 2012.

(51) Int. Cl.
*E21B 43/12* (2006.01)

(52) U.S. Cl.
CPC ..... *E21B 43/123* (2013.01)

(58) Field of Classification Search
USPC ..... 166/372
See application file for complete search history.

(56) References Cited

U.S. PATENT DOCUMENTS

| | | | | |
|---|---|---|---|---|
| 3,124,151 | A | 3/1964 | Lilly | |
| 3,208,398 | A | 9/1965 | Douglas | |
| 3,424,099 | A | 1/1969 | Peters | |
| 2001/0028850 | A1* | 10/2001 | Neumair | F04B 23/021 417/199.1 |

* cited by examiner

*Primary Examiner* — William P Neuder
*Assistant Examiner* — Ronald Runyan
(74) *Attorney, Agent, or Firm* — Michael Stonebrook

(57) ABSTRACT

A method can include selecting a ratio of a first effective cross-sectional area of a first component of a gas lift valve to a second effective cross-sectional area of a second component of the gas lift valve; charging a chamber of the gas lift valve; and positioning the gas lift valve in a pocket to expose the gas lift valve to a tubing pressure and a casing pressure, where transitioning of the gas lift valve from a closed state to an open state depends at least in part on the selected ratio. Various other apparatuses, systems, methods, etc., are also disclosed.

14 Claims, 10 Drawing Sheets

State 301

State 303

State 501

State 503

State 701

State 703

GAS LIFT VALVES

RELATED APPLICATIONS

This application claims the benefit of and priority to U.S. Provisional Application Ser. No. 61/698,589, filed 8 Sep. 2012, which is incorporated by reference herein, and to U.S. Provisional Application Ser. No. 61/698,622, filed 8 Sep. 2012, which is incorporated by reference herein.

BACKGROUND

A gas lift valve may be implemented in a gas lift system, for example, to control flow of lift gas into a production tubing conduit. As an example, a gas lift valve may be located in a gas lift mandrel, which may provide for communication with a lift gas supply, for example, in an annulus (e.g., between production tubing and casing). Operation of a gas lift valve may be determined, for example, by preset opening and closing pressures in the tubing or annulus.

SUMMARY

A method can include selecting a ratio of a first effective cross-sectional area of a first component of a gas lift valve to a second effective cross-sectional area of a second component of the gas lift valve; charging a chamber of the gas lift valve; and positioning the gas lift valve in a pocket to expose the gas lift valve to a tubing pressure and a casing pressure, where transitioning of the gas lift valve from a closed state to an open state depends at least in part on the selected ratio. A gas lift valve can include a pressurizable chamber; a first plunger that includes a chamber end that extends into the pressureizable chamber; a first bellows that biases the first plunger; a second plunger that includes an end operatively coupled to the first plunger; a second bellows that biases the second plunger; a valve plug operatively coupled to the second plunger; and a valve housing that defines at least in part a casing fluid passage, that defines at least in part a tubing fluid passage and that includes a valve seat for seating the valve plug, where a transition from a closed operational state to an open operational state of the valve plug with respect to the valve seat depends in part on a pressure in the pressurizable chamber and a ratio of an effective area of the first bellows to an effective area of the second bellows. A gas lift valve can include a pressurizable chamber; a plunger that includes a chamber end that extends into the pressureizable chamber; a bellows that biases the plunger; a valve stem that includes an end operatively coupled to the plunger; one or more dynamic seals to seal the valve stem; a valve plug operatively coupled to the valve stem; and a valve housing that defines at least in part a casing fluid passage, that defines at least in part a tubing fluid passage and that includes a valve seat for seating the valve plug, where a transition from a closed operational state to an open operational state of the valve plug with respect to the valve seat depends in part on a pressure in the pressurizable chamber and a ratio of an effective area of the bellows to an effective area of the one or more dynamic seals. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Gas lift is a process in which a gas may be injected from an annulus into tubing. An annulus, as applied to an oil well or other well for recovering a subsurface resource may refer to a space, lumen, or void between any piping, tubing or casing and the piping, tubing, or casing immediately surrounding it, at a greater radius.

As an example, injected gas may aerate well fluid in production tubing in a manner that "lightens" the well fluid such that the fluid can flow more readily to a surface location. A gas lift valves may be configured to control flow of gas during an intermittent flow or a continuous flow gas lift operation. A gas lift valve may operate based at least in part on a differential pressure control, for example, with a variable orifice size that may constrain a maximum flow rate of gas.

As gas lift valve may include a so-called hydrostatic pressure chamber that, for example, may be charged with a desired pressure. As an example, an injection-pressure-operated gas lift valve or an unloading valve can be configured so that an upper valve in a production string opens before a lower valve in the production string opens. As an example, a gas lift valve may be considered a state machine. For example, a gas lift valve, as a state machine, may include an open state and a closed state where transitions can occur therebetween. As an example, a gas lift valve may be configured, for example, in conjunction with a mandrel, for placement and/or retrieval using a kick-off tool.

Figure 1A:
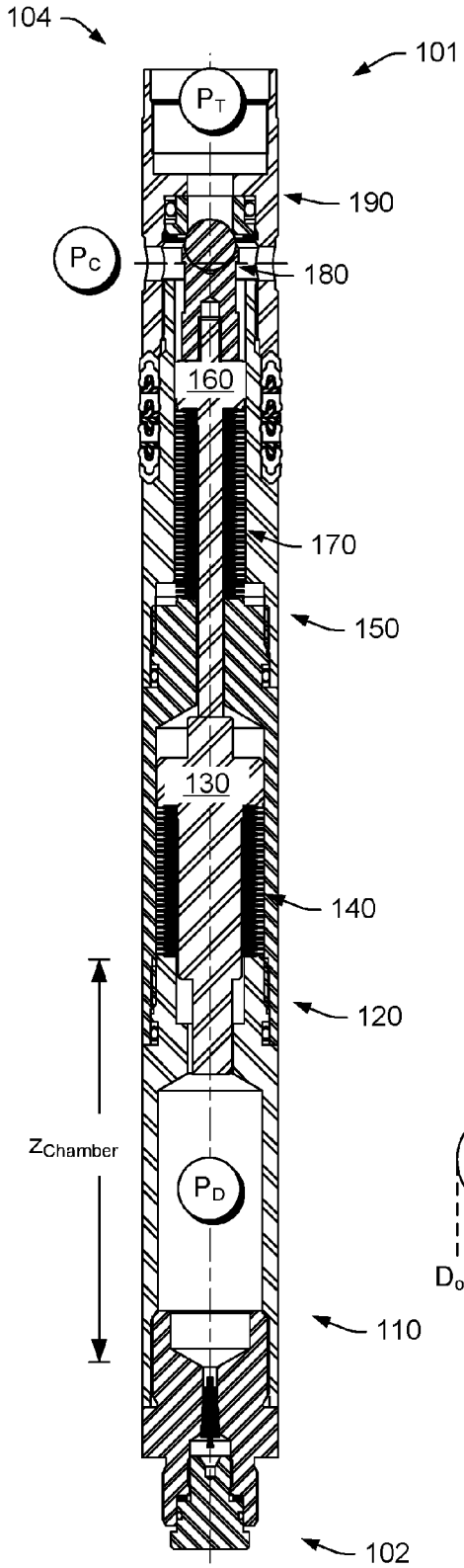
FIG. 1A illustrates an example of a gas lift valve, according to an embodiment of the disclosure.

FIG. 1A shows an example of a gas lift valve 101 that includes a first bellows 140 and a second bellows 170 in series. As an example, the two bellows 140 and 170 may be constructed of metal (e.g., or alloy). In the gas lift valve 101, the bellows 140 and 170 may be used to achieve a desired pressure rating or sensitivity.

As shown in the example of FIG. 1A, the gas lift valve 101 may include components and features that may be described with respect to a cylindrical coordinate system (e.g., r, z and Θ). From a distal end 102 to a proximal end 104, the gas lift valve 101 includes a chamber assembly 110, a first housing 120 that houses a first plunger 130 biased by the first bellows 140, a second housing 150 that houses a second plunger 160 biased by the second bellows 170, a valve plug assembly 180 and a valve housing 190.

As shown, the chamber assembly 110 may include a plug at one end (e.g., at a distal end) and include a chamber with an axial length that extends to the first bellows 140, for example, which may "plug" (e.g., seal) another end of the chamber.

Figure 1B:
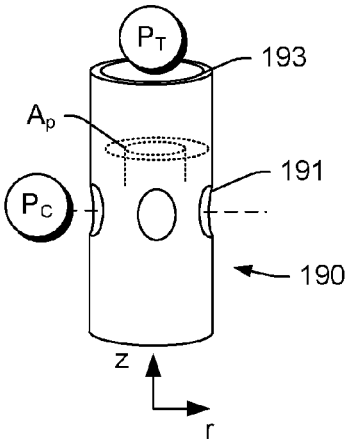
FIG. 1B illustrates a component of the gas lift valve of FIG. 1A.

As indicated in FIG. 1A, the gas lift valve 101 may include a charge pressure $P_D$, which may be referred to as a dome pressure, and may be exposed to a tubing pressure $P_T$ and a casing pressure $P_C$. As shown in FIG. 1B, the valve housing 190 can include one or more openings 191 exposed to the casing pressure $P_C$ and an opening 193 exposed to the tubing pressure $P_T$.

Figure 1C:
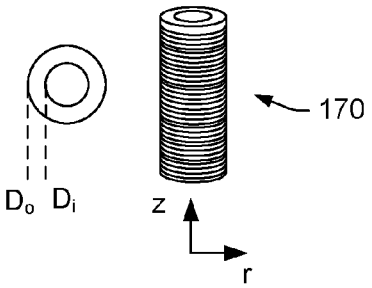
FIG. 1C illustrates a component of the gas lift valve of FIG. 1A.

With reference to FIG. 1C, the first bellows 140 may be defined in part by an inner diameter $D_i$ and an outer diameter $D_o$, which may define a mean diameter $D_m$ that may further define a cross-sectional area (e.g., $A_m=\pi(D_m/2)^2$).

Figure 1D:
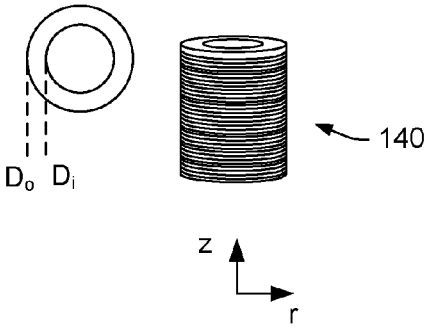
FIG. 1D illustrates a component of the gas lift valve of FIG. 1A.

With reference to FIG. 1D, the second bellows 170 may be defined in part by an inner diameter $D_i$ and an outer diameter $D_o$, which may define a mean diameter $D_m$ that may further define a mean cross-sectional area (e.g., $A_m=\pi(D_m/2)^2$).

As an example, the mean cross-sectional areas of the first bellows 140 and the second bellows 170 may be selected to have different effective working areas. In such an example, for a given pressure in the dome part of the valve ($P_D$), an operational force balance equation for the example valve may be shown to be approximately:

$$P_D*A_{m1}=P_C*(A_{m2}-A_p)+P_T*A_p$$

where $P_D$ is the dome charge pressure, $A_{m1}$ is the first bellows effective area, $P_C$ is the casing pressure (e.g., injection pressure), $A_{m2}$ is the second bellows effective area, $P_T$ is the tubing pressure, and $A_p$ is the effective port size (e.g., for an opening in the valve housing 190 to the valve plug assembly 180).

As an example, with different ratios of $A_{m1}/A_{m2}$, the pressure to open and close the example gas lift valve can be changed. For example, if the ratio $A_{m1}/A_{m2}$ is greater than 1, i.e., $A_{m1}/A_{m2}>1$, the opening and closing pressure of the valve will be larger than that of a conventional gas lift valve for a given dome charging pressure. For example, with a dome charge of about 2000 psi of nitrogen gas, and with the ratio $A_{m1}/A_{m2}$ of about 5, the opening pressure may be as high as about 10000 psi for the example gas lift valve 101. As an example, if the ratio $A_{m1}/A_{m2}$ is less than 1, i.e., $A_{m1}/A_{m2}<1$, the opening and closing pressure of the example gas lift valve 101 may be less than that of a conventional gas lift valve for a given dome charging pressure and, in such an example, sensitivity of the example gas lift valve 101 may be increased. For example, with a dome charge of 2000 psi of nitrogen gas and with the ratio of $A_{m1}/A_{m2}$ of about 0.5, the opening pressure may be as low as about 1000 psi. However, in such an example, charge pressure in the dome may double the sensitivity of the 1000 psi opening pressure where provided with a 1000 psi dome charge pressure.

As explained, in the example of FIG. 1, depending on a selected ratio of $A_{m1}/A_{m2}$, that is, the ratio of selected effective areas of two bellows in series, a given gas lift valve with the two bellows in series may be configured as a relatively high pressure opening and closing gas lift valve (e.g., compared to a conventional gas lift valve) or as a gas lift valve that may be relatively more sensitive to opening and closing pressures (e.g., compared to a conventional gas lift valve).

Figure 2A:
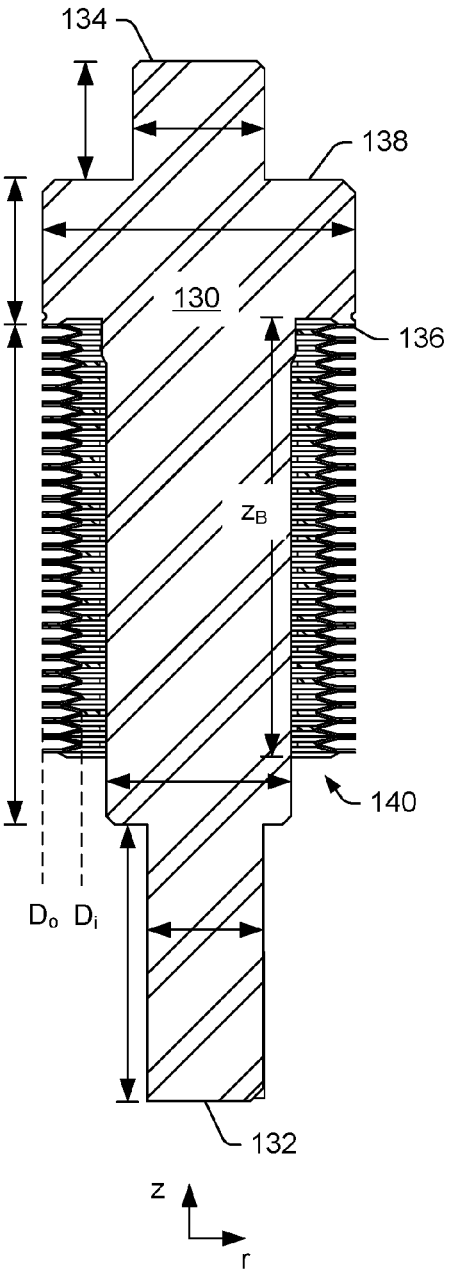
FIG. 2B illustrates a component of the gas lift valve of FIG. 1A.
FIG. 2C illustrates a component of the gas lift valve of FIG. 1A.
FIG. 2D illustrates a component of the gas lift valve of FIG. 1A.

FIGS. 2A-2D show examples of various components of the gas lift valve 101 of FIG. 1A. As shown in FIG. 2A, the first plunger 130 may include a distal end 132 and a proximal 134 and an annular portion defined in part by a lower annular face 136 and an upper annular face 138. The lower annular face 136 may seat an end of the first bellows 140 while, for example, a surface of the chamber assembly 110 may seat an opposing end of the first bellows 140. In such a manner, the first plunger 130 is biased by the first bellows 140 between a stationary seat (e.g., of the chamber assembly 110) and a seat of the first plunger 130. As an example, the first bellows 140 may be defined as having one or more spring characteristics (e.g., a linear spring equation with a spring constant, a non-linear spring equation, etc.).

Figure 2B:
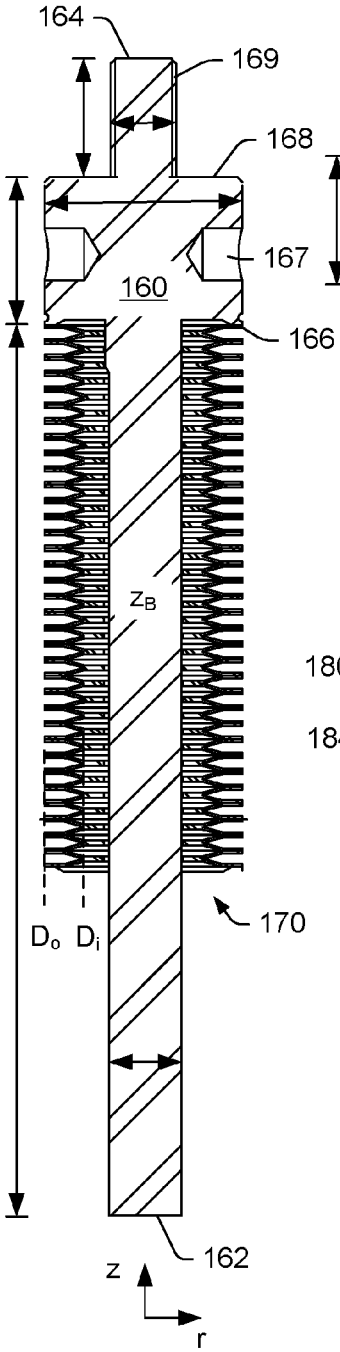

As shown in FIG. 2B, the second plunger 160 may include a distal end 162 and a proximal end 164 (e.g., of a threaded stem 169) and an annular portion defined in part by a lower annular face 166 and an upper annular face 168, optionally with one or more features 167 disposed axially therebetween. The lower annular face 166 may seat an end of the second bellows 170 while, for example, a surface of the housing 120 may seat an opposing end of the second bellows 170. In such a manner, the second plunger 160 is biased by the second bellows 170 between a stationary seat (e.g., of the housing 120) and a seat of the second plunger 160. As an example, the second bellows 170 may be defined as having one or more spring characteristics (e.g., a linear spring equation with a spring constant, a non-linear spring equation, etc.).

Figure 2C:
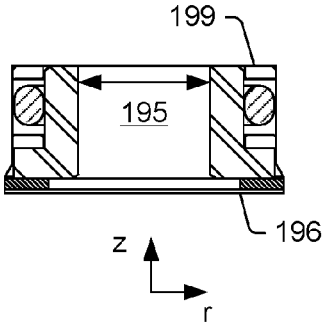
Figure 2D:
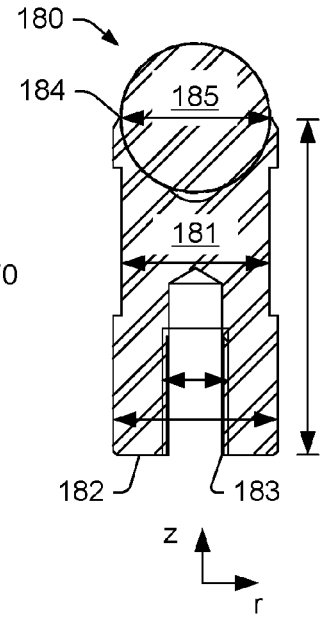

As shown in FIG. 2D, the valve assembly 180 includes a ball carrier 181 and a ball 185, which may be affixed to the ball carrier 181 (e.g., to form a unit). An upper portion of ball carrier 181 may span the diameter 184 of ball 185. The valve plug assembly 180 includes a distal end 182 with an opening to a threaded bore 183, which may be threaded onto the threaded stem 169 of the second plunger 160, for example, via the one or more features 167, which may be, for example, configured to receive a spanner tool to rotate the second plunger 160 with respect to the valve plug assembly 180 (e.g., at least the ball carrier 181 of the valve assembly 180).

As shown in FIGS. 1A and 2C, the valve housing 190 may include a valve seat component 195 (e.g., as an insert), an axial seal component 196 and a radial seal component 199 (e.g., or components). For example, the axial seal component 196 may be a retainer ring that can be received by an annular groove in the valve housing 190 to retain the valve seat component 195. As to the radial seal component 199 (e.g., or components), this may include an O-ring (e.g., elastomeric or other material) that forms a seal between a cylindrical outer surface of the valve seat component 195 and a cylindrical inner surface of the valve housing 190, for example, to reduce risk of flow as to fluid at the one or more openings 191 and/or fluid at the opening 193 (e.g., from a tubing space to a casing space and/or vice versa) when the ball 185 of the valve plug assembly 180 is seated against the valve seat component 195 (i.e., when the gas lift valve 101 is in a closed state).

As an example, a gas lift valve may include one or more seals (e.g., metal, alloy, elastomer, etc.). As an example, one or more components of a gas lift valve may be constructed of metal, alloy, etc. (e.g., tungsten carbide, INCONEL® austenitic nickel-chromium-based superalloy, etc.). As an example, a ball or other shaped valve plug may be constructed of metal, alloy, etc. (e.g., tungsten carbide, INCONEL® austenitic nickel-chromium-based superalloy, etc.). As an example, a ball or other shaped valve plug may be brazed to a ball carrier.

Figure 3A:
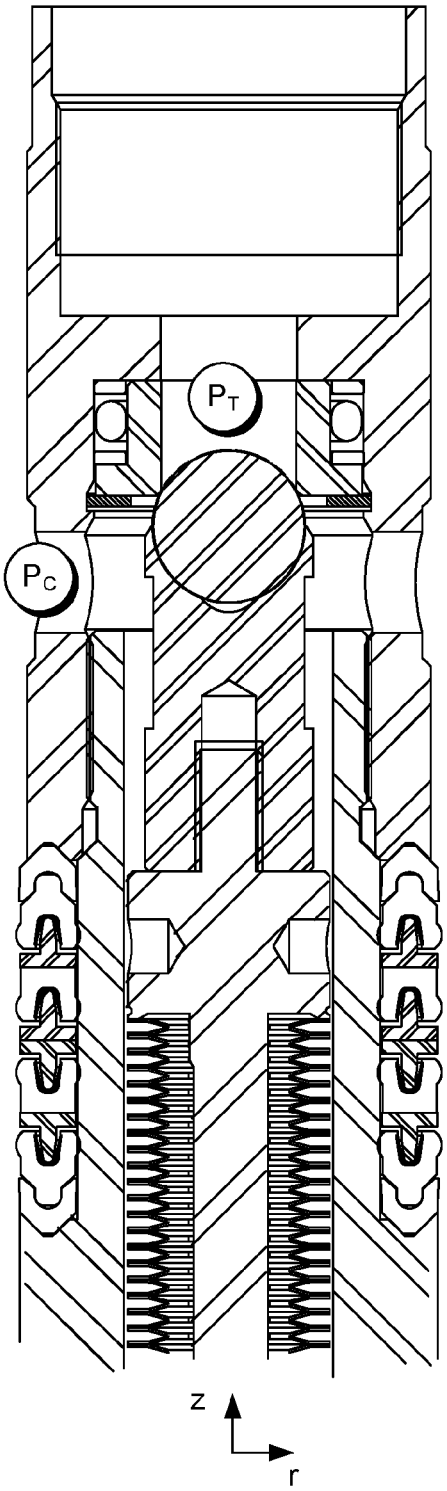
FIG. 3A illustrates an example operational state of the gas lift valve of FIG. 1A.
Figure 3B:
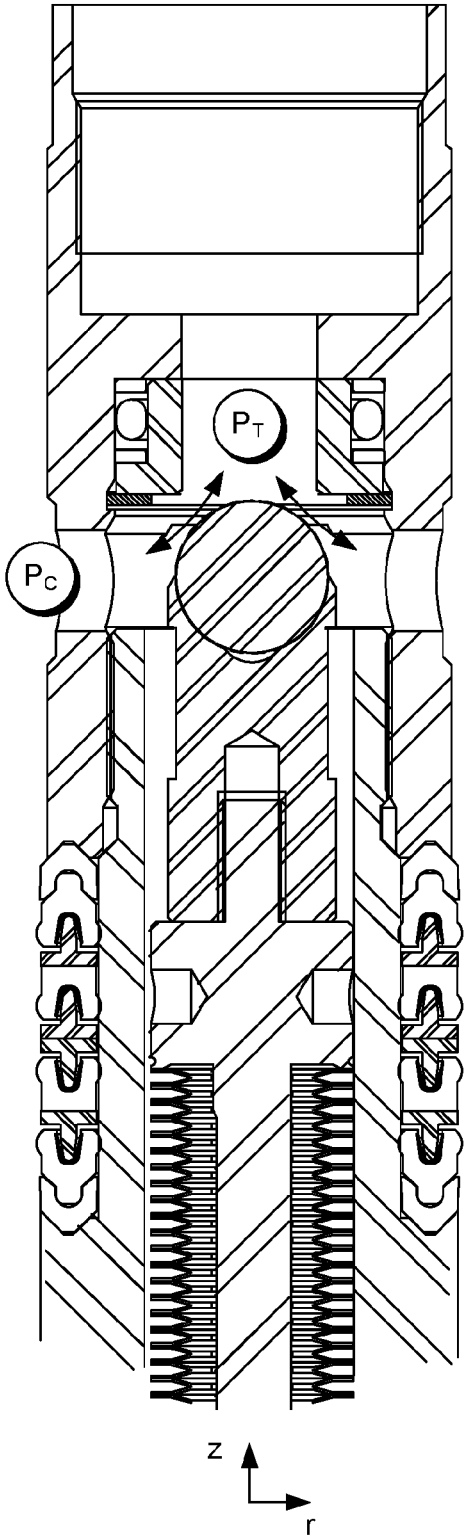
FIG. 3B illustrates an example operational state of the gas lift valve of FIG. 1A.

FIGS. 3A and 3B show examples of a portion of the gas lift valve 101 of FIG. 1A in a closed operational state 301 and in an open operational state 303. Arrows in the open operational state indicate, for example, depending on pressures, flow may be from the tubing to the casing or from the casing to the tubing. Further, as an example, the one or more openings 191 of the valve housing 190 and the opening 193 of the valve housing 190 may be configured reversely, for example, where the one or more openings 191 are in fluid communication with production tubing and where the opening 193 is in fluid communication with an annulus (e.g., options indicated by double headed arrows).

As an example, a gas lift valve may be a "no tubing effect" gas lift valve (e.g., no tubing pressure effect) in that it does not change its opening and/or closing pressure threshold or setting even when there is a change in the tubing pressure during operation of the valve. In such an example, operation of the example valve may be independent of one of the pressures that may be used to actuate a conventional gas lift valve. A no tubing pressure effect gas lift valve may, when implemented in a system, exhibit little to no noticeable dependence on tubing pressure (e.g., fluid pressure in a lumen of tubing). In such an example, the tubing pressure may be considered to be negligible as to its effect on a gas lift valve.

To achieve tubing pressure independence (e.g., a no tubing effect), as an example, a gas lift valve may include a crossover valve seat and include an effective area of a port size that may be substantially the same as an effective area of a stem (e.g., or between parts that may perform such function(s)).

As an example, valve opening force may be given by the following equation:

$$P_D*A_d-P_c*(A_{ms}-A_p)+P_T*A_p$$

where $P_D$ is the dome charge pressure, $A_d$ is the effective dome area, $P_C$ is the casing pressure, $A_{ms}$ is the mean effective seal area, $A_p$ is the port area, and $P_T$ is the tubing pressure.

As an example, where $A_{ms}$, the mean effective seal area, equals $A_p$, the port area, the factor ($A_{ms}$−Ap) becomes null (zero) and the effect of the casing pressure on the valve opening force disappears (e.g., becomes negligible). In such an example, a gas lift valve becomes a no casing effect gas lift valve (e.g., a no casing pressure effect gas lift valve).

As to opening force, also consider, as an example, the following equation:

$$P_D*A_d-P_T*(A_{ms}-A_p)+P_C*A_p$$

where $P_D$ is the dome charge pressure, $A_d$ is the effective dome area, $P_C$ is the casing pressure, $A_{ms}$ is the mean effective seal area, $A_p$ is the port area, and $P_T$ is the tubing pressure.

In the foregoing equation, where $A_{ms}$, the mean effective seal area, equals $A_p$, the port area, the factor ($A_{ms}$−$A_p$) becomes null (zero) and the effect of the tubing pressure on the valve opening force disappears (e.g., becomes negligible). In such an example, a gas lift valve becomes a no tubing effect gas lift valve (e.g., a no tubing pressure effect gas lift valve).

Figure 4A:
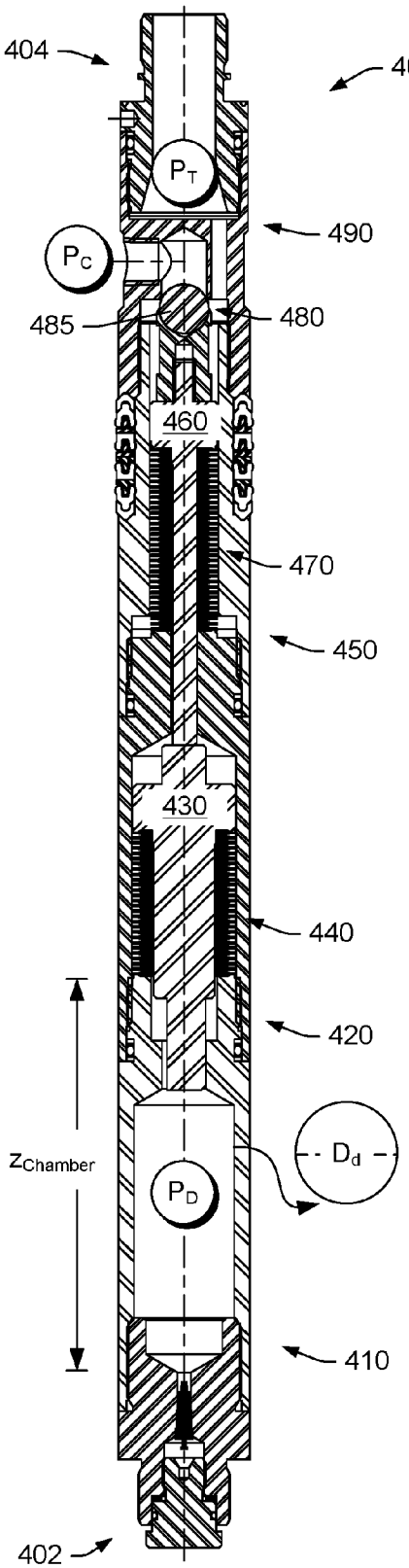
FIG. 4A illustrates an example of a gas lift valve, according to an embodiment of the disclosure.
Figure 6A:
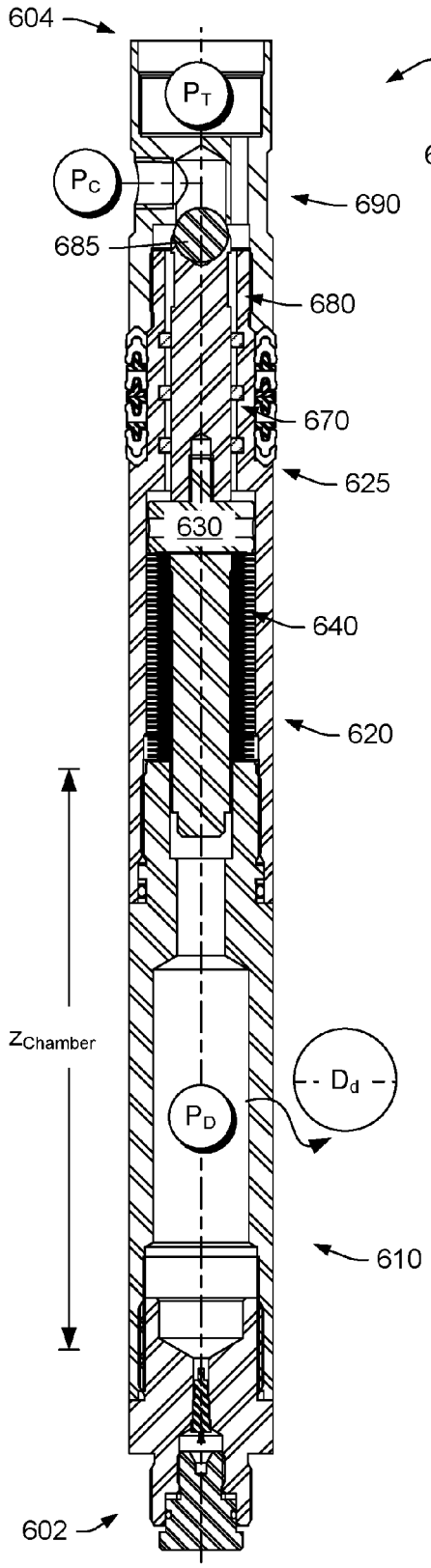
FIG. 6A illustrates an example of a gas lift valve, according to an embodiment of the disclosure.

FIGS. 4A and 6A show examples of gas lift valves 401 and 601 with configurations that may provide for cancelation of a tubing pressure to render the example gas lift valves independent of tubing pressure with regard to an opening pressure for valve actuation and with regard to a closing pressure.

In the example of FIG. 4A, the gas lift valve 401 includes a first bellows 440 and a second bellows 470 in series. As an example, the two bellows 440 and 470 may be constructed of metal (e.g., or alloy).

As shown in the example of FIG. 4A, the gas lift valve 401 may include components and features that may be described with respect to a cylindrical coordinate system (e.g., r, z and Θ). From a distal end 402 to a proximal end 404, the gas lift valve 401 includes a chamber assembly 410, a first housing 420 that houses a first plunger 430 biased by the first bellows 440, a second housing 450 that houses a second plunger 460 biased by the second bellows 470, a valve plug assembly 480 and a valve housing 490. As shown, the chamber assembly 410 may include a plug at one end (e.g., at a distal end) and include a chamber with an axial length that extends to the first bellows 440, for example, which may "plug" (e.g., seal) another end of the chamber.

Figure 4B:
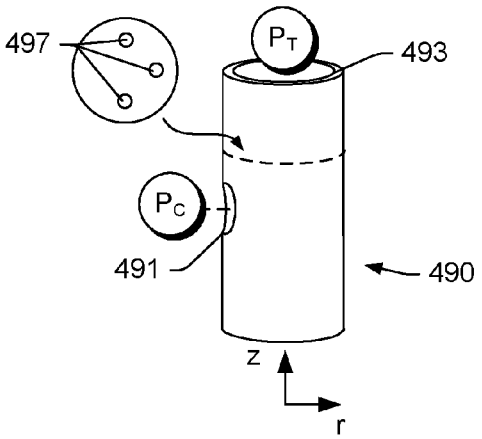
FIG. 4B illustrates a component of the gas lift valve of FIG. 4A.
Figure 4C:
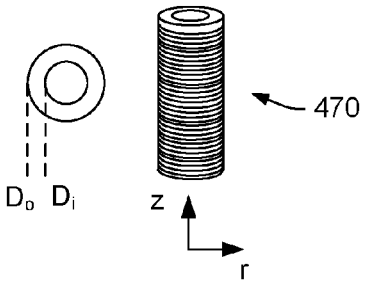
FIG. 4C illustrates a component of the gas lift valve of FIG. 4A.

As indicated in FIG. 4A, the gas lift valve 401 may include a charge pressure $P_D$, which may be referred to as a dome pressure, and may be exposed to a tubing pressure $P_T$ and a casing pressure $P_C$. As shown in FIG. 4B, the valve housing 490 can include one or more openings 491 exposed to the casing pressure $P_C$ and an opening 493 exposed to the tubing pressure $P_T$ where the opening 493 extends to a plurality of openings 497 of axial passages that lead to an annular space about a ball 485 of the valve plug assembly 480.

Figure 4D:
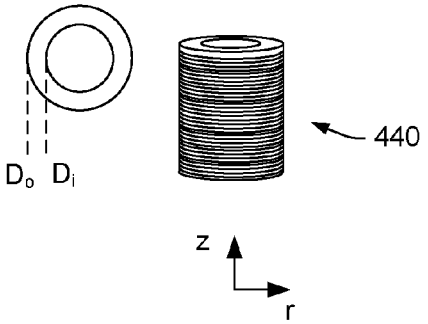
FIG. 4D illustrates a component of the gas lift valve of FIG. 4A.

As shown in FIG. 4D, the first bellows 440 may be defined in part by an inner diameter $D_i$ and an outer diameter $D_o$, which may define a mean diameter $D_m$ that may further define a cross-sectional area (e.g., $A_m=\pi(D_m/2)^2$).

As shown 4C to the second bellows 470 may be defined in part by an inner diameter $D_i$ and an outer diameter $D_o$, which may define a mean diameter $D_m$ that may further define a mean cross-sectional area (e.g., $A_m=\pi(D_m/2)^2$). As an example, the second bellows 470 may be considered to be a seal, for example, where $A_m$ of the second bellows 470 may be considered to be a mean effective seal area $A_{ms}$.

As to the chamber assembly 410, it may define a chamber that has a cylindrical portion that may be defined by a diameter $D_d$, for example, of an inner surface of a wall of the chamber assembly 410. Such a diameter may define an effective chamber cross-sectional area (e.g., $A_d=\pi(D_d/2)^2$), which may be referred to as an effective dome area ($A_d$).

In the example of FIG. 4A, the valve housing 490 is configured as a crossover valve housing. For example, when the valve housing 490 of FIG. 4B is compared to the valve housing 190 of FIG. 1B, the arrangement of the openings with respect to the ball 185 and the ball 485 may be appreciated. For the valve housing 190, the one or more openings 191 open to an annular space about the ball 185 and the opening 193 opens to a space above the ball 185, for example, where pressure is applied to a surface of the ball 185 that may be a spherical cap surface. As to the valve housing 490, the one or more openings 491 open to a space above the ball 485 and the openings 497 open to an annular space about the ball 485. Accordingly, the valve housing 490 may be defined as a crossover valve housing.

As shown in FIGS. 4A and 4B, the valve housing 490 may include an integral valve seat for seating the ball 485 of the valve plug assembly 480. As an example, the valve housing 490 may include a fitting that may be received by the opening 493, for example, to communicate fluid to or from the openings 497.

Figure 5A:
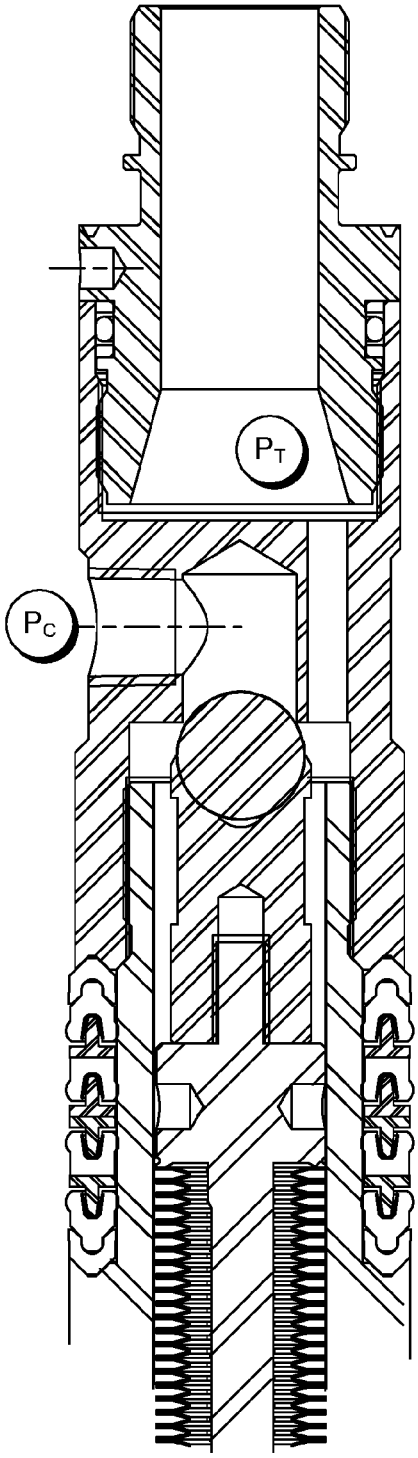
FIG. 5A illustrates an example operational state of the gas lift valve of FIG. 4A.
Figure 5B:
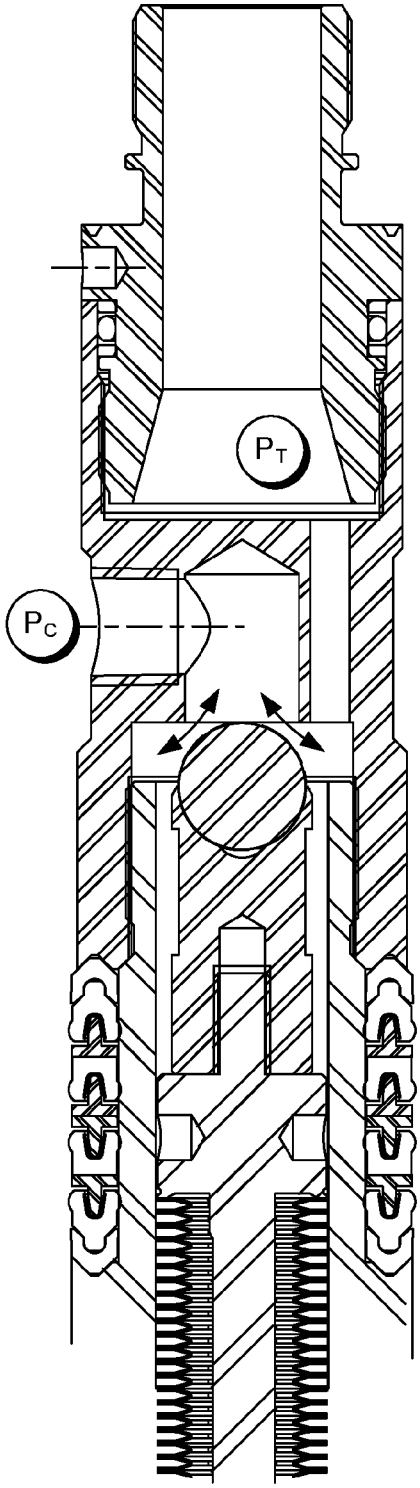
FIG. 5B illustrates an example operational state of the gas lift valve of FIG. 4A.

FIGS. 5A and 5B show examples of a portion of the gas lift valve 401 of FIG. 4A in a closed operational state 501 and in an open operational state 503, respectively. Arrows in the open operational state indicate, for example, depending on pressures, flow may be from the tubing to the casing or from the casing to the tubing. Further, as an example, the one or more openings 491 of the valve housing 490 and the opening 493 of the valve housing 490 may be configured reversely, for example, where the one or more openings 491 are in fluid communication with production tubing and where the opening 493 is in fluid communication with an annulus (e.g., options indicated by double headed arrows).

In the example of FIG. 6A, the gas lift valve 601 includes a bellows 640 and dynamic seals 670 in series with the bellows 640. As an example, the bellows 640 may be constructed of metal (e.g., or alloy). As an example, the dynamic seals 670 may be constructed of metal (e.g., or alloy) or elastomeric material. As an example, a seal may be constructed of CAM-PAC® carbon (Schlumberger, Ltd, Houston, Tex.).

As shown in the example of FIG. 6A, the gas lift valve 601 may include components and features that may be described with respect to a cylindrical coordinate system (e.g., r, z and Θ). From a distal end 602 to a proximal end 604, the gas lift valve 601 includes a chamber assembly 610, a housing 620 that houses a plunger 630 biased by the bellows 640 and that houses the dynamic seals 670 and a valve plug assembly 680, and a valve housing 690. As shown, the chamber assembly 610 may include a plug at one end (e.g., at a distal end) and include a chamber with an axial length that extends to the bellows 640, for example, which may "plug" (e.g., seal) another end of the chamber. As shown, the housing 620 includes a shoulder 625 as a transition from a larger outer diameter to a smaller outer diameter where a portion of the housing 620 with the smaller diameter may be received by the valve housing 690.

As indicated in FIG. 6A, the gas lift valve 601 may include a charge pressure $P_D$, which may be referred to as a dome pressure, and may be exposed to a tubing pressure $P_T$ and a casing pressure $P_C$. As shown, the valve housing 690 can include one or more openings 691 exposed to the casing pressure $P_C$ and an opening 693 exposed to the tubing pressure $P_T$ where the opening 693 extends to a plurality of openings 697 of axial passages that lead to an annular space about a ball 685 of the valve plug assembly 680.

Figure 6B:
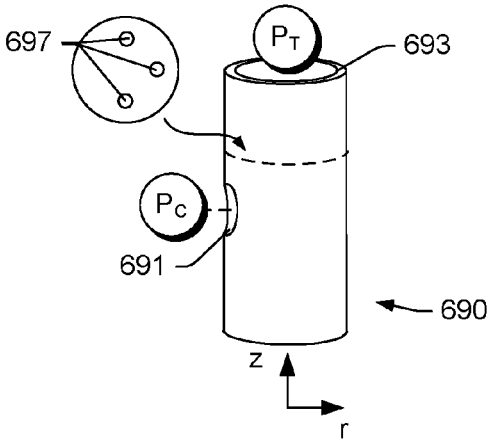
FIG. 6B illustrates a component of the gas lift valve of FIG. 6A.
Figure 6C:
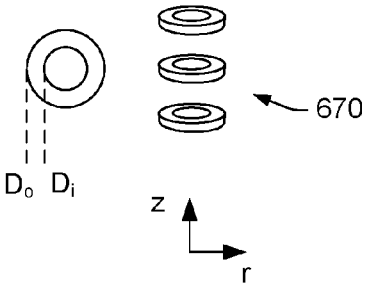
FIG. 6C illustrates a component of the gas lift valve of FIG. 6A.
Figure 6D:
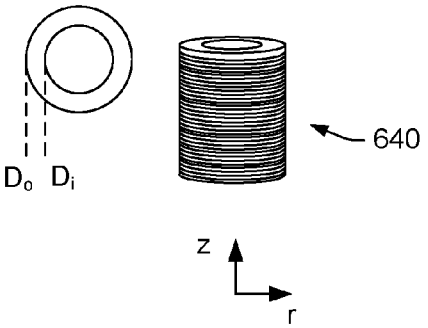
FIG. 6D illustrates a component of the gas lift valve of FIG. 6A.

As shown in FIG. 6D, bellows 640 may be defined in part by an inner diameter $D_i$ and an outer diameter $D_o$, which may define a mean diameter $D_m$ that may further define a cross-sectional area (e.g., $A_m=\pi(D_m/2)^2$).

As shown in FIG. 6C, dynamic seals 670 may be defined in part by an inner diameter $D_i$ and an outer diameter $D_o$, which may define a mean diameter $D_m$ that may further define a mean cross-sectional area (e.g., $A_m=\pi(D_m/2)^2$). As an example, the dynamic seals 670 may define a mean effective seal area $A_{ms}$.

As to the chamber assembly 610, it may define a chamber that has a cylindrical portion that may be defined by a diameter $D_d$, for example, of an inner surface of a wall of the chamber assembly 610. Such a diameter may define an effective chamber cross-sectional area (e.g., $A_d=\pi(D_d/2)^2$), which may be referred to as an effective dome area ($A_d$).

In the example of FIG. 6A, the valve housing 690 is configured as a crossover valve housing. For example, when the valve housing 690 of FIG. 6B is compared to the valve housing 190 of FIG. 1B, the arrangement of the openings with respect to the ball 185 and the ball 485 may be appreciated. For the valve housing 190, the one or more openings 191 open to an annular space about the ball 185 and the opening 193 opens to a space above the ball 185, for example, where pressure is applied to a surface of the ball 185 that may be a spherical cap surface. As to the valve housing 690, the one or more openings 691 open to a space above the ball 685 and the openings 697 open to an annular space about the ball 685. Accordingly, the valve housing 690 may be defined as a crossover valve housing.

As shown in the example of FIGS. 6A and 6B, the valve housing 690 may include an integral valve seat for seating the ball 685 of the valve plug assembly 680. As an example, the valve housing 690 may include a fitting that may be received by the opening 693, for example, to communicate fluid to or from the openings 697.

Figure 7A:
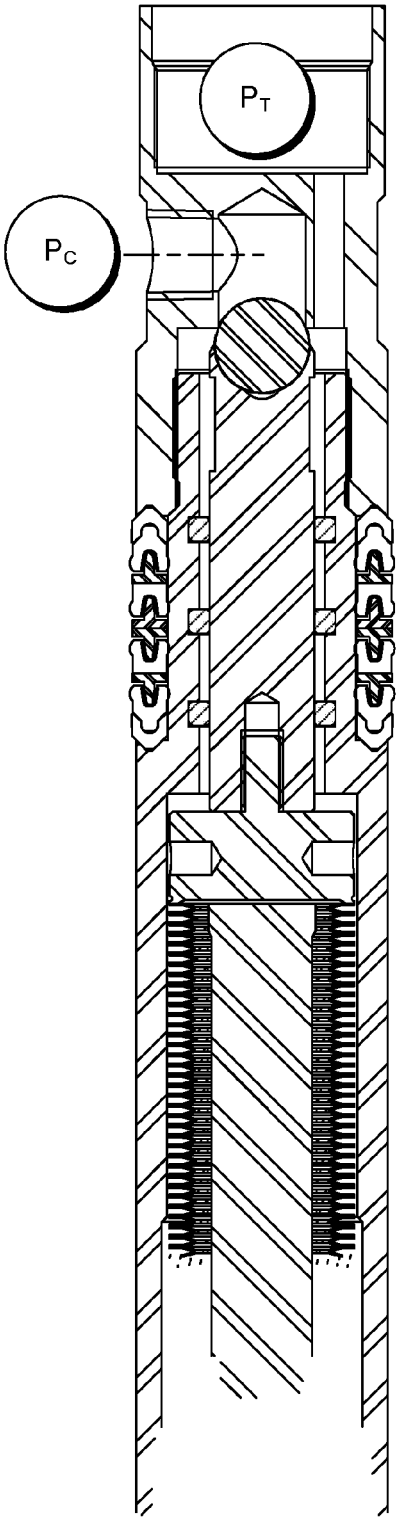
FIG. 7A illustrates an example operational state of the gas lift valve of FIG. 6A.
Figure 7B:
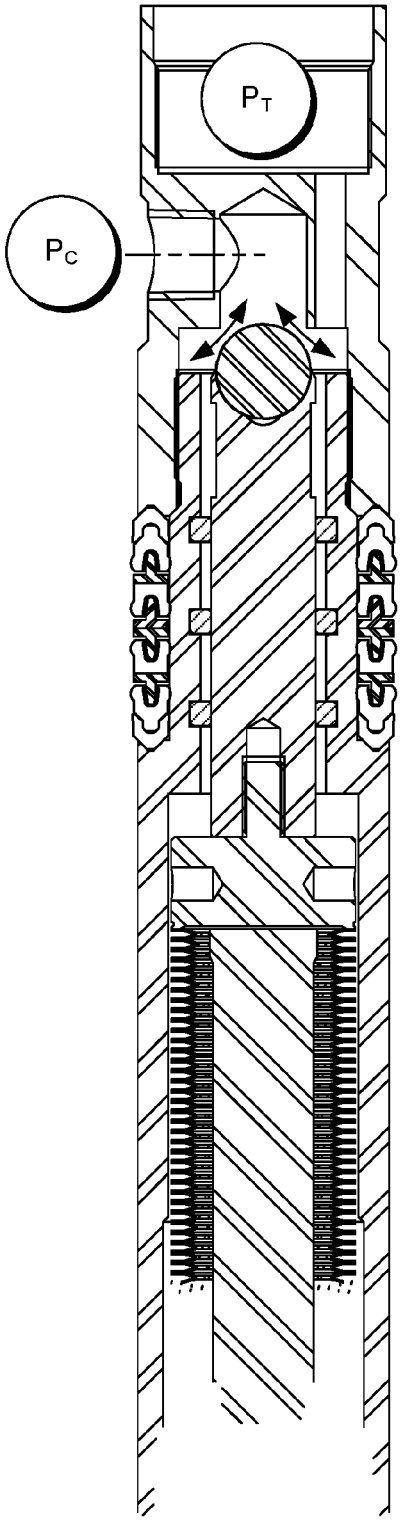
FIG. 7B illustrates an example operational state of the gas lift valve of FIG. 6A.

FIGS. 7A and 7B show examples of a portion of the gas lift valve 601 of FIG. 6A in a closed operational state 701 and in an open operational state 703, respectively. Arrows in the open operational state indicate, for example, depending on pressures, flow may be from the tubing to the casing or from the casing to the tubing. Further, as an example, the one or more openings 691 of the valve housing 690 and the opening 693 of the valve housing 690 may be configured reversely, for example, where the one or more openings 691 are in fluid communication with production tubing and where the opening 693 is in fluid communication with an annulus (e.g., options indicated by double headed arrows).

As an example, via use of a dynamic seal, a crossover seat and a seal area that matches a port area, various gas lift valves can be constructed that may reduce tubing pressure (e.g., render negligible) as a factor from affecting opening pressure and closing pressure of the valve. As an example, a gas lift valve may balance tubing pressure so that it cancels out with respect to its effect on the movement of a valve assembly (e.g., a ball and ball carrier, valve stem, valve head, valve poppet, valve disk, etc.). As an example, a gas lift valve may balance tubing pressure (or casing pressure) so that pressure acts upon a moveable valve assembly from one or more vectors or directions that do not affect axial (and effective) movement of the valve assembly (e.g., a ball and ball carrier, valve stem, valve head, valve poppet, valve disk, etc.).

Figure 8A:
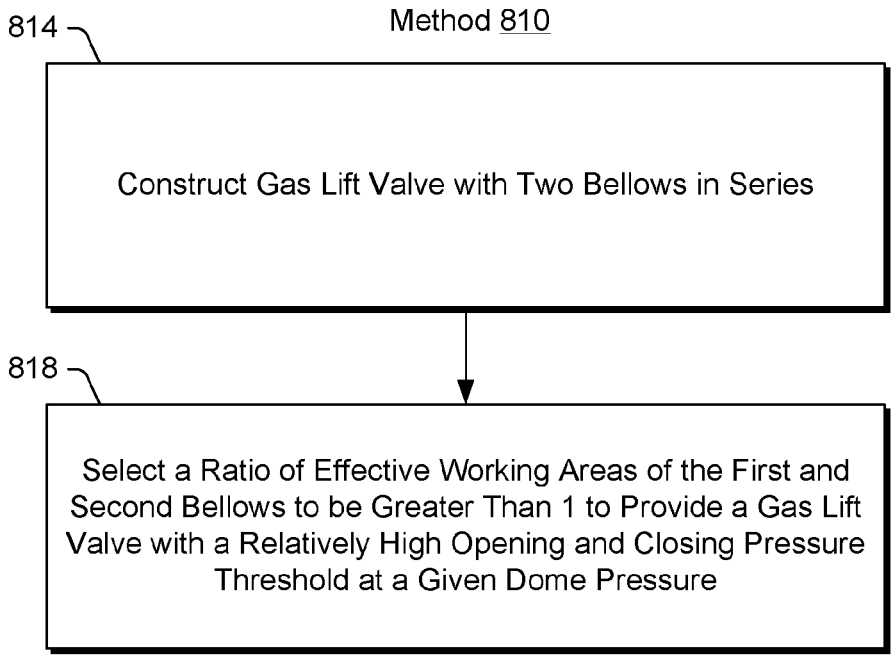
FIG. 8 illustrates examples of methods.
Figure 8B:
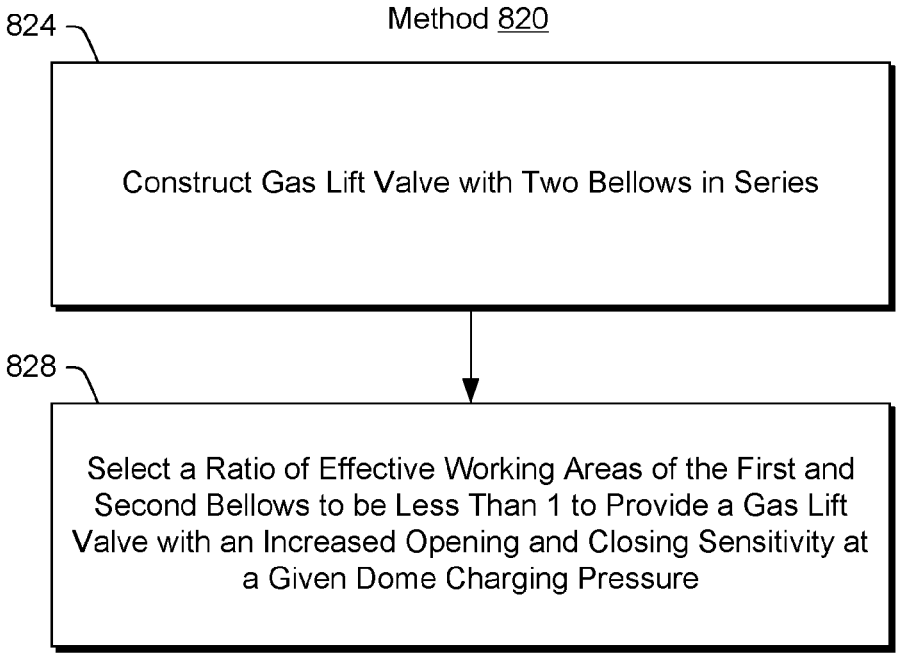

FIGS. 8A and 8B shows examples of methods 810 and 820, respectively, which may pertain to equipment that may include a gas lift valve such as the gas lift valve 101 of FIG. 1A. The method 810 includes a construction block 814 for constructing a gas lift valve with two bellows in series and a selection block 818 for selecting a ratio of effective working areas of a first and second bellows to be greater than unity to provide a gas lift valve with a relatively high opening and closing pressure threshold at a given dome pressure. The method 820 includes a construction block 824 for constructing a gas lift valve with two bellows in series and a selection block 828 for selecting a ratio of effective working areas of a first and second bellows to be less than unity to provide a gas lift valve with an increased opening and closing sensitivity at a given dome pressure.

As an example, a gas lift valve for artificial lift can include double bellows (e.g., two bellows in series). As an example, a gas lift valve for artificial lift may include two or more bellows. As an example, a gas lift valve may include a housing; a dome in the housing to hold a charge pressure; a valve seat; a valve disk or head to control a flow between a first port in communication with an annulus of a well casing and a second port in communication with a production tubing in a well; a valve stem connected to the valve disk or head; a first bellows possessing a first effective area connected to the valve stem; and a second bellows possessing a second effective area in series with the first bellows. In such an example, effective areas of the first and second bellows may be selected to provide a gas lift valve possessing a high pressure opening threshold, or a gas lift valve having an increased sensitivity to opening and closing pressures.

As an example, a method can include constructing a gas lift valve with two bellows in series; and selecting a ratio of the effective areas of the first and second bellows, A1/A2 to be greater than 1 to provide a high opening and closing pressure threshold. As an example, a method can include constructing a gas lift valve with two bellows in series; and selecting a ratio of the effective areas of the first and second bellows, A1/A2 to be less than 1 to provide an increased sensitivity to opening and closing pressures.

Figure 9:
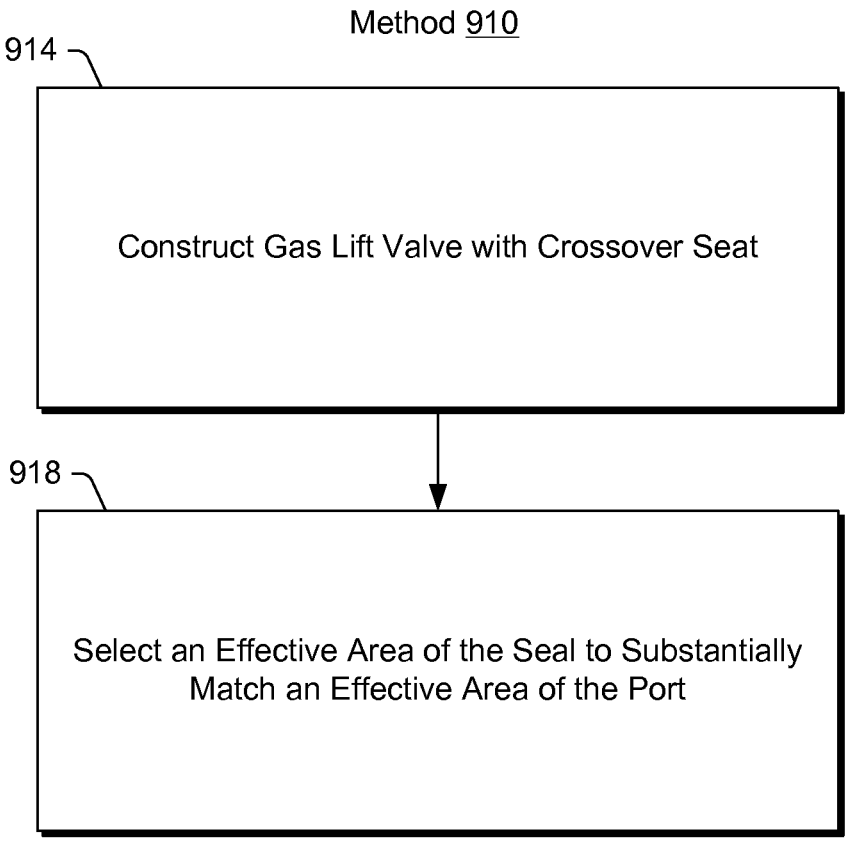
FIG. 9 illustrates an example of a method.

FIG. 9 shows an example of a method 910, which may pertain to equipment that may include a gas lift valve such as the gas lift valve 401 of FIG. 4A and/or the gas lift valve 601 of FIG. 6A. As shown in FIG. 9, the method 910 includes a construction block 914 for constructing a gas lift valve with a crossover seat and a selection block 918 for selecting an effective area of a seal to substantially match an effective area of a port. For example, the construction block 914 may include providing a crossover seat and a dynamic seal. As an example, the selection block 918 may include selecting an effective area of the dynamic seal to equal or to substantially match an effective area of a relevant port. For example, consider the following equations: $P_D*A_d=P_C*(A_{ms}\ A_p)+P_T*A_p$ where $P_D$ is the dome charge pressure, $A_d$ is the effective dome area, $P_C$ is the casing pressure, $A_{ms}$ is the effective seal area, $A_p$ is the port area, and $P_T$ is the tubing pressure.

As an example, a gas lift valve for artificial lift can include a crossover seat and a valve seal possessing an effective area substantially the same as an effective area of a port in communication with the valve seal. As an example, a gas lift valve for artificial lift can include a configuration to diminish an effect of a tubing pressure on an opening pressure and a closing pressure of the gas lift valve. In such an example, an effective area of a valve seal may be substantially the same as an effective area of a port, to diminish the effect of tubing pressure on an opening pressure and a closing pressure of the gas lift valve.

As an example, a method can include constructing a gas lift valve to include a crossover seat; and selecting an effective area of a valve seal to match an effective area of a port in communication with the valve seal, for example, to reduce effect of a pressure at the port on an opening pressure and a closing pressure of the gas lift valve (e.g., to render the effect of the pressure at the port to be negligible as to opening and closing).

Figure 10A:
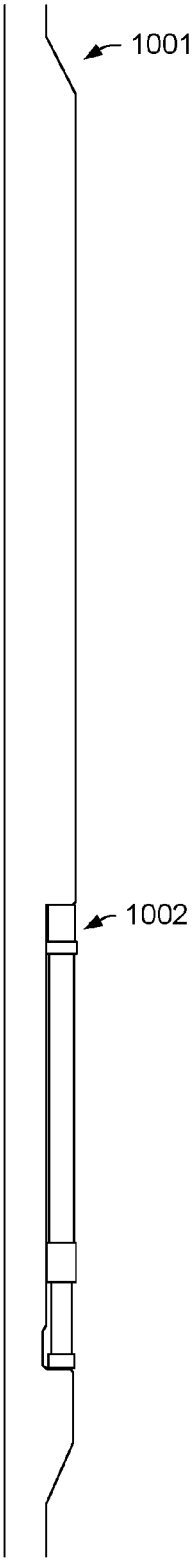
FIG. 10A illustrates an example system, according to an embodiment of the disclosure.
Figure 10B:
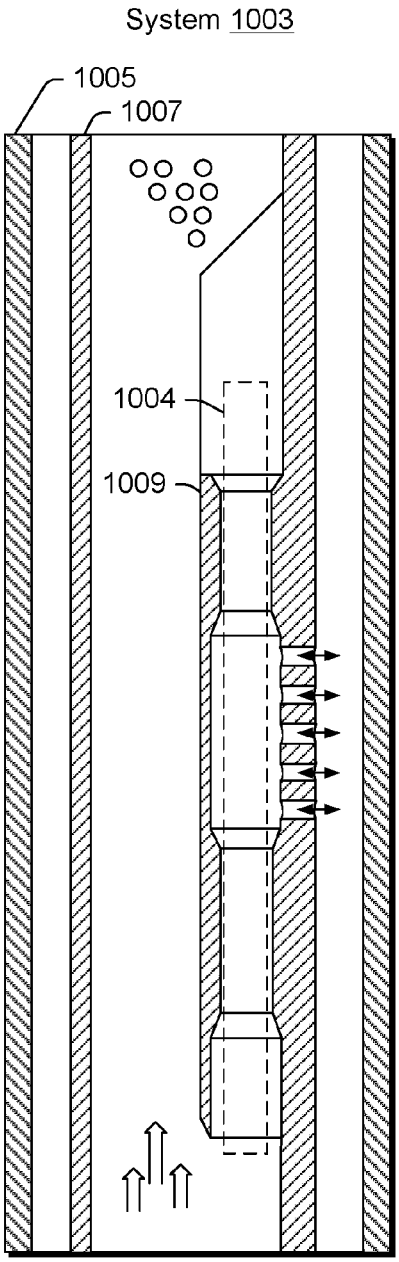
FIG. 10B illustrates an example system, according to an embodiment of the disclosure.
Figure 10C:
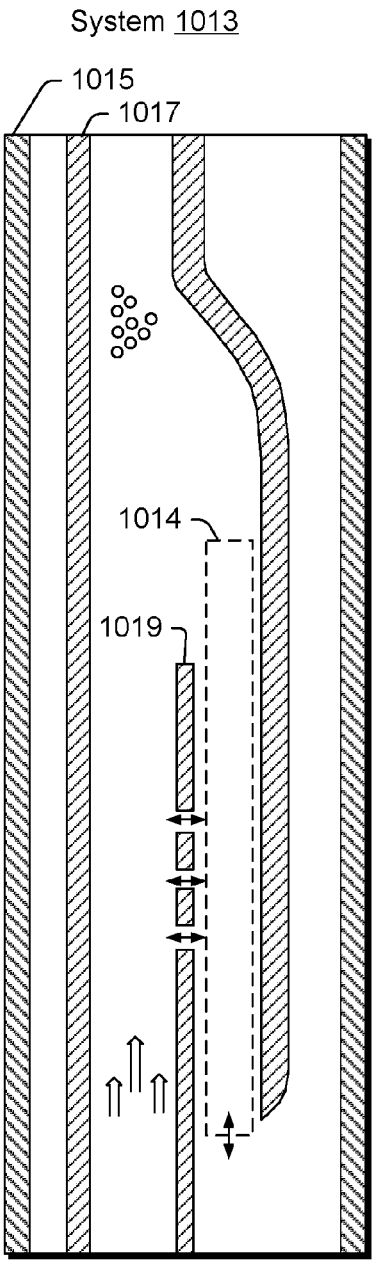
FIG. 10C illustrates an example system, according to an embodiment of the disclosure.

FIGS. 10A-10C show examples of systems 1001, 1003 and 1013. As shown, the system 1001 includes a pocket 1002 for placement of a gas lift valve. As an example, a completion may include multiple instances of the system 1001, for example, where each may include a gas lift valve where, for example, one or more of the gas lift valves may differ in one or more characteristics from one or more other of the gas lift valves. As an example, the system 1001 may include one of the gas lift valves 101, 401 or 601.

As to the system 1003, it includes a casing wall 1005 with a production tubing wall 1007 that includes a pocket 1009 configured for receipt of a gas lift valve 1004 (see dashed line). As an example, the pocket 1009 may be configured for receipt of one of the gas lift valves 101, 401 or 601. As an example, the tubing wall 1007 may include one or more openings that provide for fluid communication with fluid in an annulus defined by an outer surface of the tubing wall 1007 and an inner surface of the casing wall 1005.

As to the system 1013, it includes a casing wall 1015 with a production tubing wall 1017 that includes a pocket 1019 configured for receipt of a gas lift valve 1014 (see dashed line). As an example, the pocket 1019 may be configured for receipt of one of the gas lift valves 101, 401 or 601. As an example, the tubing wall 1017 may include one or more openings that provide for fluid communication with fluid in an annulus, defined by an outer surface of the tubing wall 1017 and an inner surface of the casing wall 1015, via a valve disposed in the pocket 1019. For example, the gas lift valve 1014 may be disposed in the pocket 1019 where a portion of the gas lift valve 1014 is in fluid communication with an annulus (e.g., with casing fluid) and where a portion of the gas lift valve 1014 is in fluid communication with a lumen (e.g., with tubing fluid). In such an example, fluid may flow from the annulus to the lumen to assist with lift of fluid in the lumen or fluid may flow from the lumen to the annulus. The pocket 1019 may include an opening that may be oriented downhole and one or more openings that may be oriented in a pocket wall, for example, directed radially to a lumen space. As an example, the pocket 1019 may include a tubing side opening (e.g., an axial opening) for placement, retrieval, replacement, etc. of a gas lift valve.

As an example, the system 1013 may be fit with a so-called no casing pressure effect gas lift valve. For example, the system 1013 may include a gas lift mandrel which can be used with a gas lift valve, as discussed herein, that has no casing pressure effect (e.g., where effect of casing pressure on valve opening force is negligible).

Figure 10D:
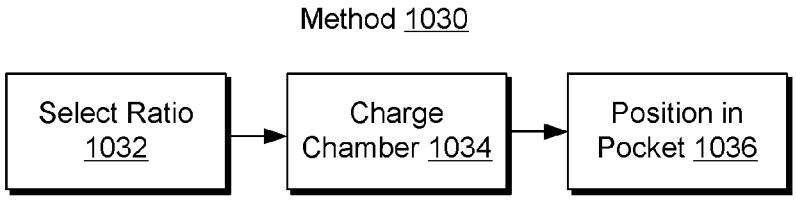
FIG. 10D illustrates an example method, according to an embodiment of the disclosure.

FIG. 10D shows an example of a method. As an example, the method 1030 may include a selection block 1032 for selecting a ratio of a first effective cross-sectional area of a first component of a gas lift valve to a second effective cross-sectional area of a second component of the gas lift valve; a charge block 1034 for charging a chamber of the gas lift valve; and a position block 1036 for positioning the gas lift valve in a pocket to expose the gas lift valve to a tubing pressure and a casing pressure, where transitioning of the gas lift valve from a closed state to an open state depends at least in part on the selected ratio. As an example, a method may include providing a gas lift valve in a pocket and actuating the gas lift valve for flow of fluid. For example, upon actuation, gas in an annulus may flow through the valve to production tubing where the gas may act to "lift" fluid in the production tubing. A method may include providing a mandrel or mandrels. A method may include providing a mandrel with one or more pockets, for example, where each pocket may receive a valve.

As an example, a gas lift valve can include a pressurizable chamber; a first plunger that includes a chamber end that extends into the pressureizable chamber; a first bellows that biases the first plunger; a second plunger that includes an end operatively coupled to the first plunger; a second bellows that biases the second plunger; a valve plug operatively coupled to the second plunger; and a valve housing that defines at least in part a casing fluid passage, that defines at least in part a tubing fluid passage and that includes a valve seat for seating the valve plug, where a transition from a closed operational state to an open operational state of the valve plug with respect to the valve seat depends in part on a pressure in the pressurizable chamber and a ratio of an effective area of the first bellows to an effective area of the second bellows. In such an example, the ratio may be, for example, greater than unity or less than unity. As an example, effective areas may be cross-sectional areas for cross-sections orthogonal to a longitudinal axis of a gas lift valve.

As an example, a gas lift valve may include a ball as a valve plug. In such an example, a ball carrier may carry the ball and operatively couples the ball to a plunger.

As an example, a valve housing of a gas lift valve may include a longitudinal axis, for example, where a casing fluid passage includes an annular portion disposed about the longitudinal axis and where a tubing fluid passage includes an axial portion aligned with the longitudinal axis. In such an example, a valve plug may be or include a ball, for example, where the casing fluid passage includes an annular portion disposed about the ball and where the tubing fluid passage includes an axial portion aligned with the ball.

As an example, a valve housing of a gas lift valve may include an insert retained by a retainer where the insert includes a valve seat (e.g., for seating a valve plug).

As an example, a gas lift valve may include a crossover valve housing. As an example, a valve housing may include a longitudinal axis, for example, where a tubing fluid passage includes an annular portion disposed about the longitudinal axis and where a casing fluid passage includes an axial portion aligned with the longitudinal axis. In such an example, a valve plug may include a ball, for example, where the tubing fluid passage includes an annular portion disposed about the ball and where the casing fluid passage includes an axial portion aligned with the ball.

As an example, a gas lift valve can include a pressurizable chamber; a plunger that includes a chamber end that extends into the pressureizable chamber; a bellows that biases the plunger; a valve stem that includes an end operatively coupled to the plunger; one or more dynamic seals to seal the valve stem; a valve plug operatively coupled to the valve stem; and a valve housing that defines at least in part a casing fluid passage, that defines at least in part a tubing fluid passage and that includes a valve seat for seating the valve plug, where a transition from a closed operational state to an open operational state of the valve plug with respect to the valve seat depends in part on a pressure in the pressurizable chamber and a ratio of an effective area of the bellows to an effective area of the one or more dynamic seals. In such an example, the valve plug may include a ball affixed to the valve stem.

As an example, gas lift valve may include a plunger and valve stem housing that houses a plunger, a bellows and a valve stem. In such an example, the plunger and valve stem housing may include a plunger portion and a valve stem portion where the valve stem portion is received by the valve housing. In such an example, the valve stem portion of the plunger and valve stem housing may include one or more seats to seat the one or more dynamic seals. Such one or more seals may be dynamic in that they seal one component with respect to another component where axial movement occurs between the components (see, e.g., the dynamic seals 670 of FIG. 6A).

As an example, a method can include selecting a ratio of a first effective cross-sectional area of a first component of a gas lift valve to a second effective cross-sectional area of a second component of the gas lift valve; charging a chamber of the gas lift valve; and positioning the gas lift valve in a pocket to expose the gas lift valve to a tubing pressure and a casing pressure, where transitioning of the gas lift valve from a closed state to an open state depends at least in part on the selected ratio. In such an example, selecting may select a ratio less than unity or select a ratio greater than unity.

CONCLUSION

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words "means for" together with an associated function.

What is claimed is:

1. A gas lift valve comprising:

a pressurizable chamber;

a first plunger that comprises a chamber end that extends into the pressurizable chamber;

a first bellows that biases the first plunger;

a second plunger that comprises an end operatively coupled to the first plunger;

a second bellows that biases the second plunger;

a valve plug operatively coupled to the second plunger; and a crossover valve housing that defines at least in part a casing fluid passage, that defines at least in part a tubing fluid passage and that comprises a valve seat for seating the valve plug, wherein a transition from a closed operational state to an open operational state of the valve plug with respect to the valve seat depends in part on a pressure in the pressurizable chamber and a ratio of an effective area of the first bellows to an effective area of the second bellows.

2. The gas lift valve of claim 1 wherein the ratio is greater than unity.

3. The gas lift valve of claim 1 wherein the ratio is less than unity.

4. The gas lift valve of claim 1 wherein the effective areas comprise cross-sectional areas for cross-sections orthogonal to a longitudinal axis of the gas lift valve.

5. The gas lift valve of claim 1 wherein the valve plug comprises a ball.

6. The gas lift valve of claim 5 wherein a ball carrier carries the ball and operatively couples the ball to the second plunger.

7. The gas lift valve of claim 1 wherein the crossover valve housing comprises an insert retained by a retainer wherein the insert comprises the valve seat.

8. The gas lift valve of claim 1 wherein the crossover valve housing comprises a longitudinal axis, wherein the tubing fluid passage comprises an annular portion disposed about the longitudinal axis and wherein the casing fluid passage comprises an axial portion aligned with the longitudinal axis.

9. The gas lift valve of claim 8 wherein the valve plug comprises a ball, wherein the tubing fluid passage comprises an annular portion disposed about the ball and wherein the casing fluid passage comprises an axial portion aligned with the ball.

10. A gas lift valve comprising:

a pressurizable chamber;

a plunger that comprises a chamber end that extends into the pressurizable chamber;

a bellows that biases the plunger;

a valve stem that comprises an end operatively coupled to the plunger;

one or more dynamic seals to seal the valve stem;

a valve plug operatively coupled to the valve stem;

a valve housing that defines at least in part a casing fluid passage, that defines at least in part a tubing fluid passage and that comprises a valve seat for seating the valve plug;

a plunger; and a valve stem housing that houses the plunger, the bellows and the valve stem, the plunger and valve stem housing comprising a plunger portion and a valve stem portion, the valve stem portion being received by the valve housing and the valve stem portion of the plunger and valve stem housing comprising one or more seats to seat the one or more dynamic seals, wherein a transition from a closed operational state to an open operational state of the valve plug with respect to the valve seat depends in part on a pressure in the pressurizable chamber and a ratio of an effective area of the bellows to an effective area of the one or more dynamic seals.

11. The gas lift valve of claim 10 wherein the valve plug comprises a ball affixed to the valve stem.

12. A method comprising:

selecting a ratio of a first effective cross-sectional area of a first bellows of a gas lift valve to a second effective cross-sectional area of a second bellows of the gas lift valve;

charging a chamber of the gas lift valve; and positioning the gas lift valve in a pocket to expose the gas lift valve to a tubing pressure and a casing pressure, wherein transitioning of the gas lift valve from a closed state to an open state depends at least in part on the selected ratio.

13. The method of claim 12 wherein the selecting comprises selecting a ratio less than unity.

14. The method of claim 12 wherein the selecting comprises selecting a ratio greater than unity.

* * * * *